US011392071B2

(12) United States Patent
Yamaguchi et al.

(10) Patent No.: US 11,392,071 B2
(45) Date of Patent: Jul. 19, 2022

(54) IMAGE FORMING APPARATUS

(71) Applicant: CANON KABUSHIKI KAISHA, Tokyo (JP)

(72) Inventors: Noritomo Yamaguchi, Kanagawa (JP); Yasuhiro Fukase, Kanagawa (JP); Takeo Kawanami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/365,853

(22) Filed: Jul. 1, 2021

(65) Prior Publication Data

US 2022/0011713 A1 Jan. 13, 2022

(30) Foreign Application Priority Data

Jul. 10, 2020 (JP) ..... JP2020-119169
May 21, 2021 (JP) ..... JP2021-086109

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS 8,254,813 B2 * 8/2012 Funamoto ..... G03G 15/50 399/302
8,340,552 B2 * 12/2012 Maehata ..... G03G 15/757 399/236
8,503,910 B2 * 8/2013 Matsuda ..... G03G 15/5008 399/167
9,217,982 B2 * 12/2015 Hashimoto ..... G03G 15/5008
9,316,989 B1 * 4/2016 Young ..... G03G 15/01
2008/0231223 A1 * 9/2008 Imai ..... G03G 15/5008 318/683
2010/0239318 A1 * 9/2010 Maehata ..... G03G 15/757 399/167
2010/0278560 A1 * 11/2010 Ino ..... G03G 15/0194 399/167
2014/0169830 A1 * 6/2014 Ino ..... G03G 15/0131 399/167

FOREIGN PATENT DOCUMENTS

JP S6311967 A 1/1988
JP 5130507 B2 1/2013

* cited by examiner

*Primary Examiner* — Sevan A Aydin
(74) *Attorney, Agent, or Firm* — Canon U.S.A., Inc. I.P. Division

(57) ABSTRACT

An image forming apparatus includes a driving unit having a first drum gear, a first coupling member, a second drum gear, and a second coupling member. The first coupling member is provided at a first position of the first drum gear. The second coupling member is provided at a second position of the second drum gear and is configured to rotate together with the second drum gear. A first angle from a first meshing position to a first transfer position in a first direction and a second angle from a second meshing position to a second transfer position in a second direction are different from each other. The second position of the second drum gear is shifted from a position corresponding to the first position of the first drum gear by a difference between the first angle and the second angle in a direction opposite of the second direction.

8 Claims, 6 Drawing Sheets

IMAGE FORMING APPARATUS

BACKGROUND

Field

The present disclosure relates to an image forming apparatus including a driving unit that drives a plurality of photosensitive drums.

Description of the Related Art

As an electrophotographic color image forming apparatus, there is known a tandem-type image forming apparatus including independent image forming units for respective colors. The tandem-type image forming apparatus transfers images from the respective photosensitive drums of the image forming units onto an intermediate transfer belt so as to superimpose the images, and further transfers the images from the intermediate transfer belt onto a recording medium all at once. The tandem-type image forming apparatus thus has an issue where the occurrence of speed fluctuations of the plurality of photosensitive drums and the intermediate transfer belt causes color misregistration in which the superimposed images are misaligned and the respective colors are misregistered.

To reduce the color misregistration caused by the occurrence of the speed fluctuations, it is necessary to prevent the influence of the speed fluctuations of the plurality of photosensitive drums and the intermediate transfer belt from appearing on the image.

Japanese Patent Application Laid-Open No. 63-11967 discusses a technique for reducing the color misregistration caused by the speed fluctuation of the intermediate transfer belt. According to the technique discussed in Japanese Patent Application Laid-Open No. 63-11967, a plurality of photosensitive drums is driven by a common driving source, and is spaced at a distance that allows the time interval of when the intermediate transfer belt passes between adjacent transfer positions to be equal to an integral multiple of the cycle of driving unevenness of the driving source.

According to Japanese Patent Application Laid-Open No. 63-11967, it is possible to reduce the influence of the speed fluctuation during the cycle of the driving roller that drives the intermediate transfer belt. However, this technique fails to reduce the influence of speed fluctuations of driving gears that drive the photosensitive drums.

Japanese Patent No. 5130507 discusses a technique for reducing the speed fluctuations of the driving gears that drive the photosensitive drums. According to the technique discussed in Japanese Patent No. 5130507, after the phases of one-revolution fluctuations of a driving gear and a coupling are measured for each of the components, the driving gear and the coupling are connected to each other at a position where the phase of the one-revolution fluctuation of the driving gear and the phase of the one-revolution fluctuation of the coupling are relatively shifted from each other from an aligned state. Furthermore, Japanese Patent No. 5130507 discusses that using a composite amplitude obtained by connecting one driving gear and one coupling in the above-described manner as a reference, the other driving gears and the other couplings are connected in the above-described manner so that the other composite amplitudes match the reference composite amplitude.

However, the technique discussed in Japanese Patent No. 5130507 has an issue where the composite amplitudes are matched by connecting the driving gears and the couplings while relatively shifting them, but the rotational phases are not aligned with one another, thereby not addressing misregistration among the respective colors, which is caused by rotational fluctuations among the plurality of photosensitive drums. More specifically, the technique discussed in Japanese Patent No. 5130507 has an issue where the misregistration among the respective colors caused by the rotational fluctuations among the plurality of photosensitive drums is not addressed unless the driving gears and the couplings with the composite amplitudes matched are further subjected to rotational phase control for aligning the rotational phases with one another.

SUMMARY

The present disclosure is directed to reducing misregistration among respective colors due to rotational fluctuations among a plurality of photosensitive drums, without performing rotational phase control for aligning the rotational phases with one another.

According to an aspect of the present disclosure, an image forming apparatus includes a transfer member configured to move in a movement direction, a first photosensitive drum disposed in contact with the transfer member at a first transfer position, a second photosensitive drum disposed in contact with the transfer member at a second transfer position, wherein the second photosensitive drum is arranged adjacent to and side by side with the first photosensitive drum in the movement direction, and the second transfer position is located downstream of the first transfer position in the movement direction, and a driving unit configured to drive the first photosensitive drum and the second photosensitive drum, wherein the driving unit includes: (i) a driving source, (ii) at least one driving force transmission gear configured to rotate by receiving a driving force from the driving source, (iii) a first drum gear that meshes with the at least one driving force transmission gear, wherein the first drum gear is configured to receive the driving force from the at least one driving force transmission gear to rotate in a first direction and drive the first photosensitive drum, (iv) a first coupling member provided at a first position of the first drum gear in the first direction, wherein the first coupling member is configured to rotate together with the first drum gear, and to rotate the first photosensitive drum while engaging with the first photosensitive drum, (v) a second drum gear that meshes with the at least one driving force transmission gear, wherein the second drum gear is configured to receive the driving force from the at least one driving force transmission gear to rotate in a second direction and drive the second photosensitive drum, and (vi) a second coupling member provided at a second position of the second drum gear in the second direction, wherein the second coupling member is configured to rotate together with the second drum gear, and to rotate the second photosensitive drum while engaging with the second photosensitive drum, wherein, assuming that a position where the first drum gear meshes with the at least one driving force transmission gear is a first meshing position and a position where the second drum gear meshes with the at least one driving force transmission gear is a second meshing position, a first angle from the first meshing position to the first transfer position in the first direction and a second angle from the second meshing position to the second transfer position in the second direction are different from each other, and wherein the second position of the second drum gear is shifted from a position corresponding to the first position of the first drum gear by a difference between the first angle and the second angle in a direction opposite of the second direction.

Further features of the present disclosure will become apparent from the following description of exemplary embodiments with reference to the attached drawings.

DESCRIPTION OF THE EMBODIMENTS

Hereinafter, exemplary embodiments of the present disclosure will be described in detail with reference to the drawings. Dimensions, materials, shapes, and relative arrangement of components according to the exemplary embodiments described below may be changed as appropriate based on the configuration of an apparatus to which any of the exemplary embodiments of the present disclosure is applied and various kinds of conditions, and are not intended to limit the scope of the present disclosure only thereto.

Hereinafter, an image forming apparatus including a driving unit according to a first exemplary embodiment will be described. In the following exemplary embodiments, a full-color image forming apparatus to which four process cartridges are detachably attached will be described as an example of an image forming apparatus. The number of process cartridges attached to an image forming apparatus is not limited to four, and may be appropriately set as necessary.

<Schematic Configuration of Image Forming Apparatus>

Figure 3:
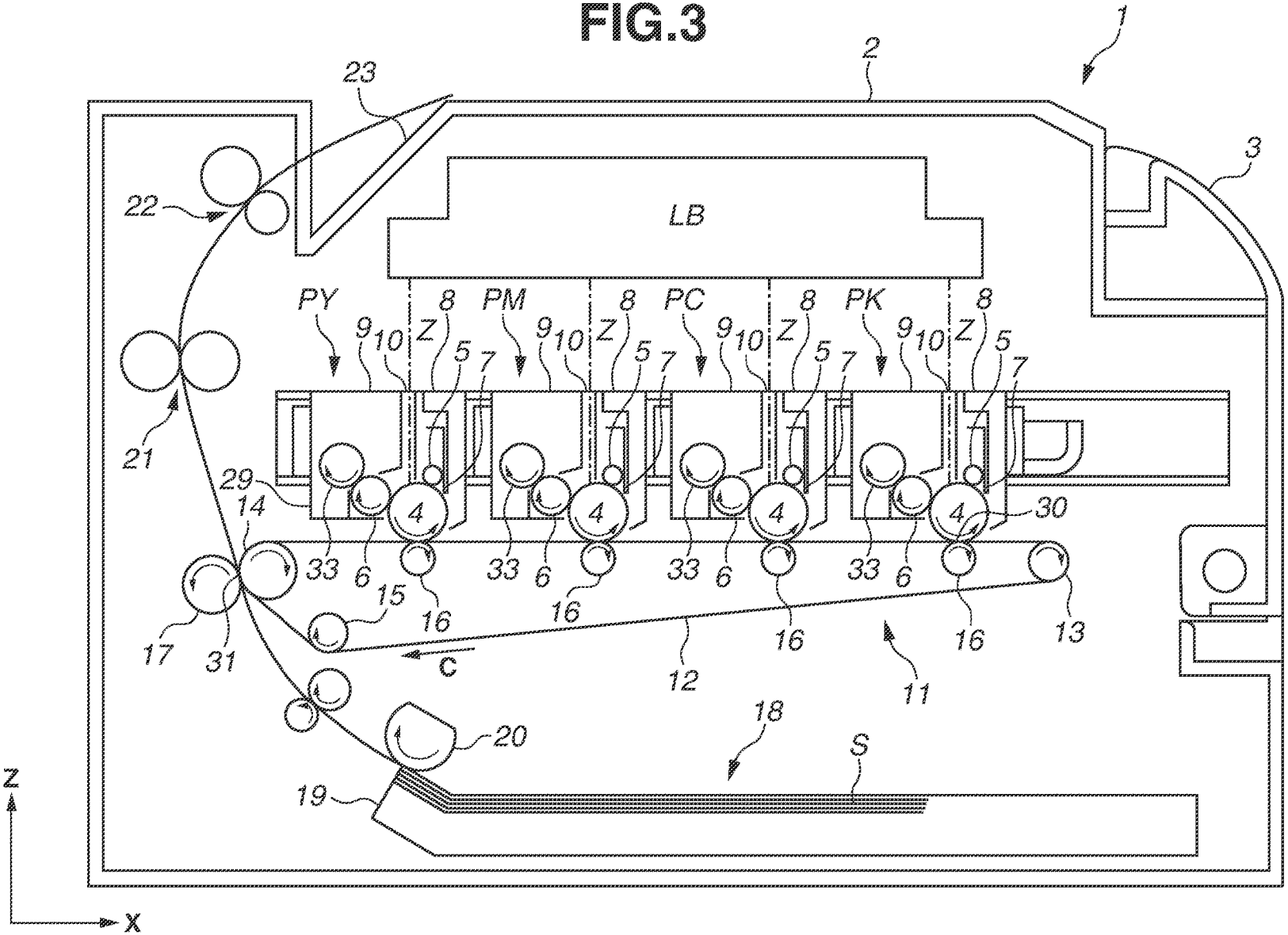
FIG. 3 is a cross-sectional view illustrating an image forming apparatus including the driving unit.

First, a schematic configuration of an image forming apparatus according to the present exemplary embodiment will be described with reference to FIG. 3. FIG. 3 is a cross-sectional view illustrating an image forming apparatus 1 as the image forming apparatus according to the present exemplary embodiment.

The image forming apparatus 1 can form a color image on a recording medium S in a state where four process cartridges P (PY, PM, PC, and PK) (hereinafter referred to as the cartridges P) for different colors are detachably attached to an apparatus main body 2 thereof.

In FIG. 3, the side of the image forming apparatus 1 on which an apparatus opening/closing door 3 is provided is defined as the front (front side) and the opposite side of the front side is defined as the back (back side). In addition, when the image forming apparatus 1 is viewed from the front side, the right side and the left side are referred to as the driving side and the non-driving side, respectively. In other words, FIG. 3 illustrates the cross section of the image forming apparatus 1 viewed from the non-driving side. The front side, the back side, the right side, and the left side of FIG. 3 correspond to the non-driving side, the driving side, the front side, and the back side of the image forming apparatus 1, respectively.

In the apparatus main body 2, the four cartridges P (PY, PM, PC, and PK), namely, the first cartridge PY, the second cartridge PM, the third cartridge PC, and the fourth cartridge PK are arranged in the horizontal direction.

Each of the first to fourth cartridges P (PY, PM, PC, and PK) is configured similarly to one another, and includes process members that act on a photosensitive drum 4. In this example, each of the cartridges P includes a charging member, a development member, and a cleaning member, which will be described below, as the process members. Each of the first to fourth cartridges P (PY, PM, PC, and PK) is used for a different color toner.

Bias voltages (e.g., charging bias voltage, development bias voltage) are supplied from the apparatus main body 2 to each of the first to fourth cartridges P (PY, PM, PC, and PK). A rotational driving force is transmitted from a driving unit provided in the apparatus main body 2 to each of the first to fourth cartridges P (PY, PM, PC, and PK). A configuration of the driving unit will be described below.

Each of the first to fourth cartridges P (PY, PM, PC, and PK) according to the present exemplary embodiment includes a drum unit 8 as a first unit and a development unit 9 as a second unit. The drum unit 8 includes the photosensitive drum 4, a charging roller 5 as the charging member, and a cleaning blade 7 as the cleaning member. The development unit 9 includes a development roller (a developer bearing member) 6 as the development member and a supply roller 33. The drum unit 8 and the development unit 9 are joined to each other.

The first cartridge PY contains yellow (Y) toner in a development frame body 29 of the development unit 9, and forms a yellow toner image on the surface of the photosensitive drum 4. The second cartridge PM contains magenta (M) toner in the development frame body 29 of the development unit 9, and forms a magenta toner image on the surface of the photosensitive drum 4. The third cartridge PC contains cyan (C) toner in the development frame body 29 of the development unit 9, and forms a cyan toner image on the surface of the photosensitive drum 4. The fourth cartridge PK contains black (K) toner in the development frame body 29 of the development unit 9, and forms a black toner image on the surface of the photosensitive drum 4.

As an exposure unit, a laser scanner unit LB is provided above the first to fourth cartridges P (PY, PM, PC, and PK). The laser scanner unit LB outputs laser light Z corresponding to image information. The output laser light Z passes through an exposure window portion 10 of each of the cartridges P to scan and expose the surface of the photosensitive drum 4.

As a transfer unit, an intermediate transfer belt unit 11 is provided below the first to fourth cartridges P (PY, PM, PC, and PK). The intermediate transfer belt unit 11 includes a driving roller 14, a tension roller 13, and an assist roller 15, and a flexible transfer belt 12 that is stretched across the driving roller 14, the tension roller 13, and the assist roller 15.

The surface of the photosensitive drum 4 in each of the first to fourth cartridges P (PY, PM, PC, and PK) is in contact with the outer peripheral surface of the transfer belt 12 serving as a transfer member. A primary transfer roller 16 is provided on the inner side of the transfer belt 12 so as to face each of the photosensitive drums 4. A primary transfer portion 30 is where the photosensitive drum 4 and the primary transfer roller 16 face each other and the photosensitive drum 4 and the transfer belt 12 are in contact with each other.

A secondary transfer roller 17 is brought into contact with the driving roller 14 via the transfer belt 12. A secondary transfer portion 31 is where the driving roller 14 and the secondary transfer roller 17 face each other and the transfer belt 12 and the secondary transfer roller 17 are in contact with each other.

A feeding unit 18 is provided below the intermediate transfer belt unit 11. The feeding unit 18 includes a feeding tray 19 in which the recording medium S is stacked and accommodated, and a feeding roller 20 which feeds the recording medium S accommodated in the feeding tray 19.

A fixing unit 21 and a discharge unit 22 are provided in the upper left portion of the apparatus main body 2 illustrated in FIG. 3. The fixing unit 21 fixes toner images transferred to the recording medium S onto the recording medium S. The discharge unit 22 discharges the recording medium S to a discharge tray 23 provided on the top surface of the apparatus main body 2.

The image forming apparatus 1 according to the present exemplary embodiment has been described to have the configuration in which each of the cartridges P detachably attached to the apparatus main body 2 includes the drum unit 8 (including the photosensitive drum 4) and the development unit 9 (including the development roller 6) that are joined to each other, but may have a configuration different from this configuration. For example, the image forming apparatus 1 may include at least one photosensitive drum 4 and at least one charging roller 5 in the apparatus main body 2, and a cleaning unit including the cleaning blade 7 may be detachably attached as the cartridge P to the apparatus main body 2.

<Image Forming Operation>

An operation to form a full-color image will be described next.

The photosensitive drum 4 in each of the first to fourth cartridges P (PY, PM, PC, and PK) is rotationally driven at a predetermined speed in the direction indicated by a corresponding arrow in FIG. 3 (i.e., the counterclockwise direction). The transfer belt 12 is also rotationally driven at a speed corresponding to the speed of the photosensitive drum 4 in the forward direction of the rotation of the photosensitive drum 4 (the direction indicated by an arrow C in FIG. 3).

The laser scanner unit LB is also driven. In synchronization with the driving of the laser scanner unit LB, the charging roller 5 in each of the cartridges P uniformly charges the surface of the photosensitive drum 4 to a predetermined polarity and potential. The laser scanner unit LB scans and exposes the surface of each of the photosensitive drums 4 with the laser light Z based on an image signal of the corresponding color. Accordingly, an electrostatic latent image based on the image signal of the corresponding color is formed on the surface of each of the photosensitive drums 4. The formed electrostatic latent image is developed by the development roller 6 that is rotationally driven at a predetermined speed in the direction indicated by a corresponding arrow in FIG. 3 (i.e., the clockwise direction).

In the first cartridge PY, the yellow toner image corresponding to the yellow component of the full-color image is formed on the photosensitive drum 4 by the above-described electrophotographic image forming process operation. The yellow toner image formed on the photosensitive drum 4 is primarily transferred onto the transfer belt 12 by the primary transfer roller 16 at the primary transfer portion 30.

Similarly, in the second cartridge PM, the magenta toner image corresponding to the magenta component of the full-color image is formed on the photosensitive drum 4. The magenta toner image formed on the photosensitive drum 4 is primarily transferred onto the transfer belt 12 by the primary transfer roller 16 at the primary transfer portion 30, so as to be superimposed on the yellow toner image that has already been transferred to the transfer belt 12.

Similarly, in the third cartridge PC, the cyan toner image corresponding to the cyan component of the full-color image is formed on the photosensitive drum 4. The cyan toner image formed on the photosensitive drum 4 is primarily transferred onto the transfer belt 12 by the primary transfer roller 16 at the primary transfer portion 30, so as to be superimposed on the yellow toner image and the magenta toner image that have already been transferred to the transfer belt 12.

Similarly, in the fourth cartridge PK, the black toner image corresponding to the black component of the full-color image is formed on the photosensitive drum 4. The black toner image formed on the photosensitive drum 4 is primarily transferred onto the transfer belt 12 by the primary transfer roller 16 at the primary transfer portion 30, so as to be superimposed on the yellow toner image, the magenta toner image, and the cyan toner image that have already been transferred to the transfer belt 12.

In this manner, the unfixed full-color toner images of the four colors, namely, the yellow color, the magenta color, the cyan color, and the black color are formed on the transfer belt 12.

Meanwhile, sheets of the recording medium S accommodated in the feeding tray 19 are separated and fed one by one by the feeding roller 20. Each sheet of the recording medium S is guided to the secondary transfer portion 31, which is the contact portion of the secondary transfer roller 17 and the transfer belt 12, at a predetermined control timing. At the secondary transfer portion 31, the toner images of the four colors superimposed on the transfer belt 12 are secondarily transferred onto the recording medium S all at once.

The toner images transferred to the recording medium S are fixed onto the recording medium S by the fixing unit 21. The recording medium S with the images fixed thereon is discharged to the discharge tray 23 on the top surface of the apparatus main body 2 by the discharge unit 22.

<Configuration of Driving Unit>

A configuration of a driving unit 50 for driving the plurality of photosensitive drums 4 will be described next. The configuration of the driving unit 50 will be described with reference to FIGS. 1 to 4A, using a part of the driving unit 50 that drives two of the photosensitive drums 4 adjacent to each other, as an example.

Figure 1:
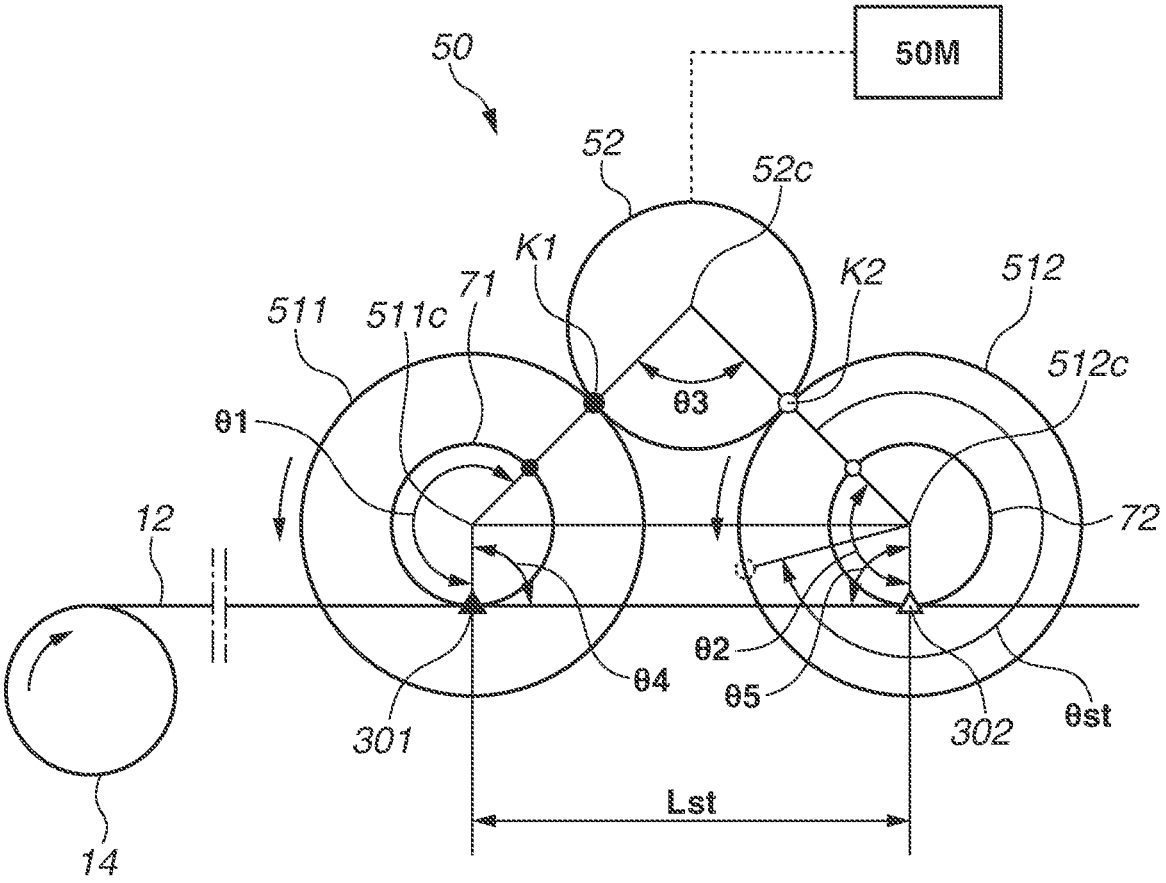
FIG. 1 is a diagram illustrating a configuration of a driving unit that drives a plurality of drum gears using a single driving force transmission gear.
Figure 4A:
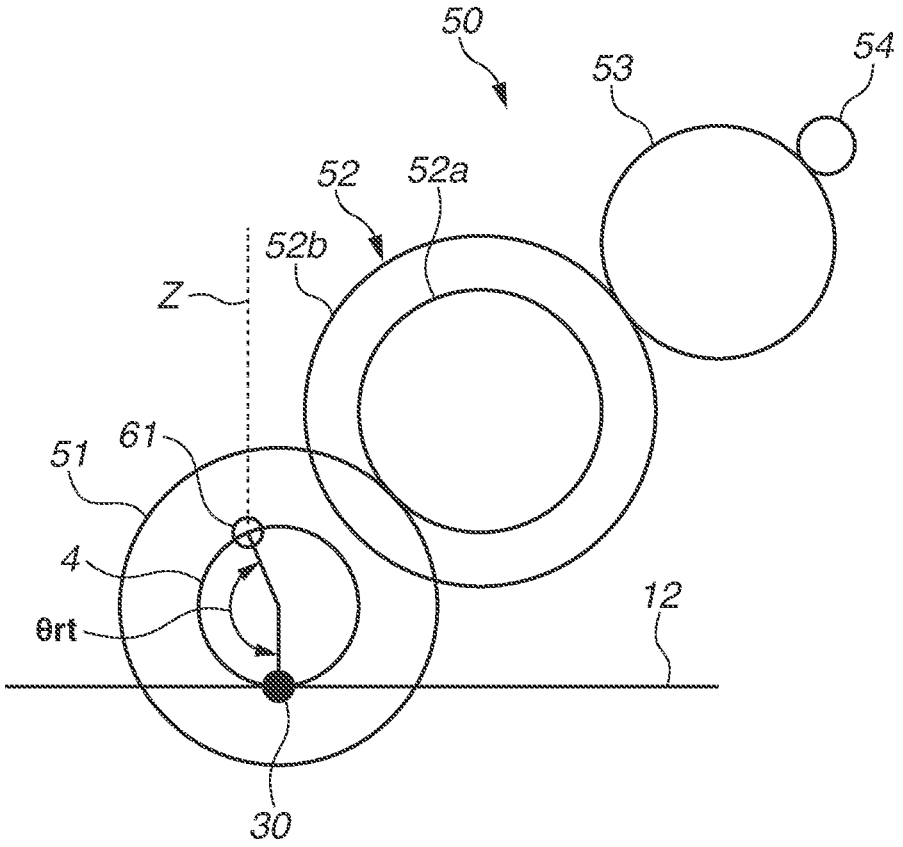
FIG. 4A is a diagram illustrating a part of the configuration of the driving unit.

FIGS. 1 and 4A illustrate the driving unit 50 that drives a first photosensitive drum and a second photosensitive drum that is arranged adjacent to and side by side with the first photosensitive drum in the movement direction of the transfer belt 12. For example, in FIG. 3, if the photosensitive drum 4 in the process cartridge PY is assumed to be the first photosensitive drum, the photosensitive drum 4 in the process cartridge PM is the second photosensitive drum. The driving unit 50 illustrated in FIG. 1 drives the first photosensitive drum that is brought into contact with the transfer belt 12 at a first transfer position 301 (corresponding to the primary transfer portion 30 of FIG. 3) where the toner image is transferred. The driving unit 50 illustrated in FIG. 1 also drives the second photosensitive drum that is brought into contact with the transfer belt 12 at a second transfer position 302 (corresponding to the primary transfer portion 30 of FIG. 3) located downstream of the first transfer position 301 in the movement direction of the transfer belt 12.

As illustrated in FIGS. 1 and 4A, the driving unit 50 includes a driving motor 50M as a driving source, and a driving force transmission gear 52 that rotates by receiving a driving force from the driving motor 50M. The driving unit 50 further includes drum couplings 71 and 72 and drum gears 511 and 512. The drum couplings 71 and 72 are drum coupling members that engage with the photosensitive drums 4. The drum gears 511 and 512 rotationally drive the drum couplings 71 and 72. The driving force transmission gear 52 transmits the driving force from the driving motor 50M to each of the drum gears 511 and 512. The drum gear 511 is a first drum gear that meshes with the driving force transmission gear 52 and is configured to rotate in a first direction by receiving the driving force from the driving force transmission gear 52, thereby driving the first photosensitive drum. The drum coupling 71 is a first coupling member provided at a first position of the drum gear 511 in the first direction and configured to rotate together with the drum gear 511. The drum coupling 71 also rotates the first photosensitive drum while engaging with the first photosensitive drum. The drum gear 512 is a second drum gear that meshes with the driving force transmission gear 52 and is configured to rotate in a second direction by receiving the driving force from the driving force transmission gear 52, thereby driving the second photosensitive drum. The drum coupling 72 is identical to the drum coupling 71 in amplitude variation (speed variation) during one rotation cycle from a reference phase. The drum coupling 72 is a second coupling member provided at a second position of the drum gear 512 in the second direction and configured to rotate together with the drum gear 512. The drum coupling 72 also rotates the second photosensitive drum while engaging with the second photosensitive drum.

<Causes for Occurrence of Color Misregistration>

When the toner image formed on each of the photosensitive drums 4 is transferred onto the transfer belt 12 at the primary transfer portion 30 so as to be superimposed on the toner image(s) already transferred to the transfer belt 12, the toner image may be transferred in a state of being shifted from a predetermined position, thereby causing color misregistration. Causes for the occurrence of color misregistration will be described next. Types of color misregistration include steady color misregistration and non-steady color misregistration. The steady color misregistration and the non-steady color misregistration will be described in this order.

The steady color misregistration occurs due to, for example, the shift of the position irradiated with the laser light Z of each color. Thus, in each image forming apparatus 1, the shift amount of the position irradiated with the laser light Z is detected using a sensor (not illustrated) that detects the position of the toner transferred to the transfer belt 12, and the irradiation timing of the laser light Z is adjusted, thereby correcting the shift of the position.

The non-steady color misregistration occurs due to, for example, the speed fluctuation caused by the eccentricity of the driving roller 14 that drives the transfer belt 12 or the eccentricity of the photosensitive drums 4 and the driving gears that drive the photosensitive drums 4.

<Reduction in Color Misregistration Due to Eccentricity of Transfer Belt Driving Roller>

The following configuration is provided to reduce the non-steady color misregistration caused by a driving component of the transfer belt 12. The plurality of photosensitive drums 4 is driven by the common driving source, and is spaced at a distance that allows the time interval of when the transfer belt 12 passes between the adjacent primary transfer portions 30 to be equal to an integral multiple of the cycle of driving unevenness of the driving source.

The configuration will be further described with reference to FIG. 1. Assuming that Lst represents the distance (the spacing) between the first and second transfer positions 301 and 302, which is the spacing between the primary transfer portions 30 adjacent to each other, and Di represents the diameter of the driving roller 14, the photosensitive drums 4 are arranged to satisfy the following relation.

$$Lst=N\pi Di(N\text{:integer})$$

The satisfaction of the relation expressed by the above-described equation allows the transfer belt 12 to pass between the photosensitive drums 4 at the same speed variation cycle, thereby reducing the color misregistration due to the eccentricity of the driving roller 14 that drives the transfer belt 12.

<Speed Fluctuations Due to Eccentricity of Motor and Gears>

Similarly, one of the causes for the non-steady color misregistration is speed fluctuations due to the eccentricity of the motor and the gears that drive the photosensitive drums 4. More specifically, this is a phenomenon in which, while the gears are rotating, if any of the gears swings to shift the rotational axis of the gear from the center, the rotational speed slows down at a portion where the distance from the center to the surface of the gear is long and speeds up at a portion where the distance from the center to the surface of the gear is short.

To reduce the influence of the eccentricity of the motor and the gears, a configuration in which the numbers of teeth of the gears are selected is provided, so that the color misregistration is reduced.

The configuration will be described with reference to FIGS. 4A and 4B, using the rotational fluctuation of the photosensitive drum 4 as an example. FIG. 4A illustrates a part of the driving unit 50 that drives the photosensitive drums 4. The driving unit 50 includes the drum gear 51 (511 or 512), which drives the photosensitive drum 4, a stepped gear (driving force transmission gear) 52, which drives the drum gear 51, an idler gear 53, which drives the stepped gear 52, and a pinion gear 54, which drives the idler gear 53 and is attached to the driving motor 50M (the driving source). The stepped gear 52 includes a small gear 52*a* and a large gear 52*b* larger in diameter than the small gear 52*a*. The pinion gear 54 attached to the driving motor 50M meshes with the idler gear 53. The idler gear 53 meshes with the large gear 52*b* of the stepped gear 52. The small gear 52*a* of the stepped gear 52 meshes with the drum gear 51. The driving force from the driving motor 50M is transmitted to the drum gear 51, so that the photosensitive drum 4 is rotationally driven.

Assume that an exposure position 61 is a position at which the photosensitive drum 4 is irradiated with the laser light Z emitted from the laser scanner unit LB, and the primary transfer portion 30 is a contact portion at which the photosensitive drum 4 is in contact with the transfer belt 12. The photosensitive drum 4 is rotationally driven by the drum gear 51 to which the driving force is transmitted. The surface of the photosensitive drum 4 is exposed by the laser light Z of the laser scanner unit LB, so that the electrostatic latent image is formed thereon.

Assume that, when θrt represents an angle from the exposure position 61 to the primary transfer portion 30 on the drum shaft, t(θrt) represents the time required for the photosensitive drum 4 to rotate by θrt.

Figure 4B:
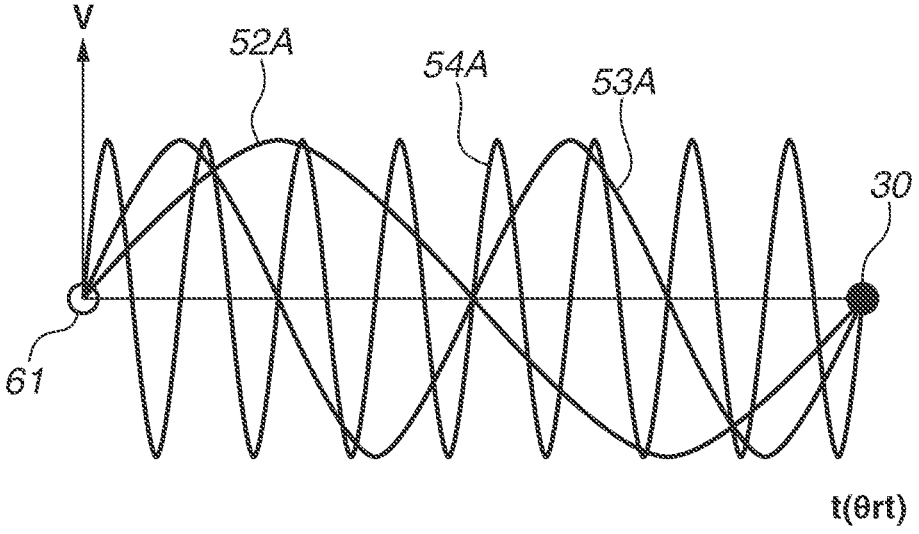
FIG. 4B is a diagram illustrating the cycle of each gear for which the number of teeth is adjusted to an integral multiple.

FIG. 4B illustrates the speed fluctuations of the stepped gear 52, the idler gear 53, and the pinion gear 54 that drive the photosensitive drum 4, with the elapse of the time t(θrt) during which the photosensitive drum 4 rotates by the angle θrt. In FIG. 4B, the vertical axis and the horizontal axis represent a speed V and the time t(θrt), respectively.

In FIG. 4B, a stepped gear speed fluctuation 52A indicates the speed fluctuation of the stepped gear 52, an idler gear speed fluctuation 53A indicates the speed fluctuation of the idler gear 53, and a pinion gear speed fluctuation 54A indicates the speed fluctuation of the pinion gear 54.

Assume that, in this case, the number of teeth of the drum gear 51 is z51, the number of teeth of the small gear 52*a* of the stepped gear 52 is z52*a*, the number of teeth of the large gear 52*b* of the stepped gear 52 is z52*b*, the number of teeth of the idler gear 53 is z53, and the number of teeth of the pinion gear 54 is z54. In order to set the number of rotations of each of the gears to an integer, the number of teeth of each of the gears is set to satisfy the following relation, using the number of teeth z51 of the drum gear 51 as a reference.

$$Zdr\times\theta rt=z52a$$

$$z52b=2\times z53=6\times z54$$

In this case, since the stepped gear 52 (with the number of teeth z52*a* of the small gear 52*a* and the number of teeth z52*b* of the large gear 52*b*) is an integrated gear, the rotation amount of the small gear 52*a* and the rotation amount of the large gear 52*b* are equal to each other.

The rotation amount corresponding to Zdr×θrt is defined to be f(Zdr×θrt). In this case, similarly, the rotation amount of the small gear 52*a* having the number of teeth z52*a* can be expressed as f(z52*a*). The small gear 52*a* and the large gear 52*b* are integrated as the stepped gear 52, and this means that the rotation amount f(z52*b*) of the large gear 52*b* having the number of teeth z52*b* is equal to the rotation amount f(z52*a*) of the small gear 52*a*, i.e., f(z52*a*)=f(z52*b*).

Thus, when all the rotation amounts of the gears are expressed as an equation, the following relation is satisfied among the rotation amounts of the gears.

$$f(Zdr\times\theta rt)=f(z52a)=f(z52b)=2\times f(z53)=6\times f(z54)$$

The relation among the actual numbers of teeth of the respective gears is as follows.

The number of teeth z51 (Zdr) of the drum gear 51 is 103, and the angle θrt from the exposure position 61 to the primary transfer portion 30 is 178.25° (51/103×360 degrees). Accordingly, the rotation amount of the drum gear 51 is the rotation amount corresponding to Zdr×θrt=51 teeth.

The number of teeth z52*a* of the small gear 52*a* of the stepped gear 52 is 51. Thus, the rotation amount of the small gear 52*a* is the rotation amount corresponding to Zdr×θrt=1×z52*a* teeth. The number of teeth z52*b* of the large gear 52*b* of the stepped gear 52 is 72. Since the large gear 52*b* is integrated with the small gear 52*a*, the rotation amount of the large gear 52*b* is equal to the rotation amount of the small gear 52*a* (i.e., the rotation amount corresponding to the number of teeth z52*b*=the rotation amount corresponding to the number of teeth z52*a*).

The number of teeth z53 of the idler gear 53 is 36. Thus, the rotation amount of the idler gear 53 is the rotation amount corresponding to Zdr×θrt=z52*a*=z52*b*=2×z53.

The number of teeth z54 of the pinion gear 54 is 12. Thus, the rotation amount of the pinion gear 54 is the rotation amount corresponding to Zdr×θrt=z52*a*=z52*b*=2×z53=6×z54.

In this manner, the relationship among the gears is such that, when the drum gear 51 rotates from the exposure position 61 to the primary transfer portion (the transfer position) 30, each of the gears 52, 53, and 54 in the preceding stage rotates the integer number of times.

FIG. 4B illustrates the rotational fluctuations at this time. When the drum gear 51 rotates from the exposure position 61 to the primary transfer portion 30, i.e., when the time t(θrt) has elapsed, each of the stepped gear 52, the idler gear 53, and the pinion gear 54 rotates the integer number of times. Accordingly, the respective fluctuations of the three gears 52, 53, and 54 during one rotation are in phase, and the speed fluctuations of the motor and the gears are in phase at the exposure position 61 and the transfer position 30. Thus, the present configuration can reduce the color misregistration caused by the speed fluctuations due to the eccentricity of the motor and the gears.

<Reduction in Color Misregistration Caused by Rotational Fluctuations Due to Degrees of Precision and Eccentricity of Drum Gears>

Next, the rotational fluctuation due to the eccentricity of the drum gear 51 that drives the photosensitive drum 4 will be described. Similarly to the gears described so far, the drum gear 51 is also subjected to a rotational fluctuation due to the degree of precision and the eccentricity. The driving unit 50 used in the image forming apparatus 1 including the plurality of photosensitive drums 4 includes the drum gears 51 that drive the photosensitive drums 4 as many as the number of photosensitive drums 4. In such a configuration, it is desirable that the drum gears 51 driving the respective photosensitive drums 4 have the same shape in order to reduce color misregistration due to an error in the meshing and transmission of the drum gears 51. In the present exemplary embodiment, the drum gears 51 that drive the respective photosensitive drums 4 are molded with the same mold cavity.

Using the drum gears 51 of the same shape allows the degree of precision and the eccentricity to be kept constant among the drum gears 51 that drive the respective photosensitive drums 4. Thus, it is desirable to use the drum gears 51 molded with the same mold cavity, as the drum gears 51 that drive the respective photosensitive drums 4.

Phase alignment among the respective drum gears 51 will be described with reference to FIGS. 1 to 2D. FIG. 1 illustrates a part of the driving unit 50 that drives the adjacent two photosensitive drums 4 using the respective drum gears 511 and 512, and drives the drum gears 511 and 512 using the same driving force transmission gear 52.

Assume that Lst (unit: mm) represents the distance between the first and second transfer positions 301 and 302 adjacent to each other, Vi (unit: mm/sec) represents the speed of the transfer belt 12, and Rd (unit: rps) represents the rotational speed of the photosensitive drum 4. In this case, in order to drive the drum gear 512 at the same meshing position as that of the drum gear 511, the phases of the drum gears 511 and 512 adjacent to each other need to be aligned in the following manner. More specifically, the phase of the drum gear 512 needs to be aligned with a phase obtained by rotating the drum gear 512 by an angle θst in the opposite direction (the clockwise direction in FIG. 1) of the rotational direction, using a second meshing position K2 of the drum gear 512 as a reference. In this case, the angle θst by which the drum gear 512 rotates before the image formed on the first transfer position 301 reaches the second transfer position 302 can be expressed by the following equation.

$$\theta st=Lst/Vi\cdot Rd\times 360$$

The phase alignment between the adjacent drum gears 511 and 512 will be described in further detail. As described above, the drum gears 511 and 512 are molded with the same cavity of the same mold. Thus, the phase of the tooth of the drum gear 512 corresponding to the tooth of the drum gear 511 that meshes with the driving force transmission gear 52 at the first meshing position K1 is aligned with the phase obtained by rotating the drum gear 512 by the angle θst in the opposite direction (the clockwise direction in FIG. 1) of the rotational direction, using the second meshing position K2 as the reference. The position of the tooth of the drum gear 512 corresponding to the tooth of the drum gear 511 that meshes with the driving force transmission gear 52 at the first meshing position K1 is indicated by a broken line circle in FIG. 1.

Figures 2A, 2B, 2C, 2D:
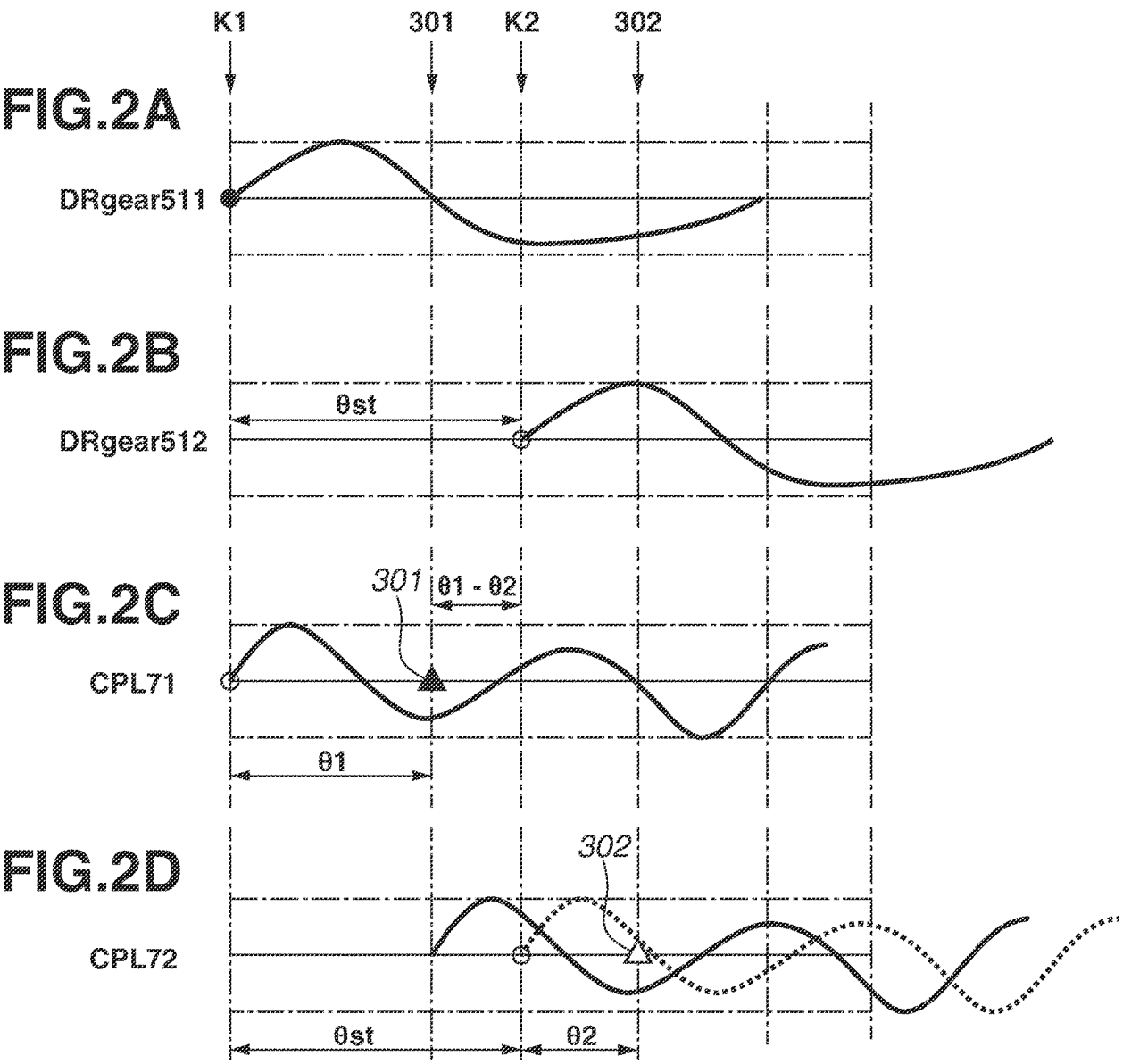
FIGS. 2A to 2D are diagrams illustrating phase alignment of drum gears and couplings in the driving unit.

FIG. 2A illustrates how the speed of the drum gear 511 fluctuates during one rotation cycle of the drum gear 511 from the first meshing position K1. FIG. 2B illustrates how the speed of the drum gear 512 fluctuates during one rotation cycle of the drum gear 512 from the second meshing position K2.

In this example, the angular difference between the first meshing position K1 and the second meshing position K2 can be expressed as the angle Est. Using the drum gears 511 and 512 of the same shape allows the speed fluctuations during one rotation cycle to be brought into phase at the respective meshing positions K1 and K2 with the driving force transmission gear 52. Thus, the present configuration can reduce the color misregistration caused by the rotational fluctuations due to the degrees of precision and the eccentricity of the drum gears.

<Reduction in Color Misregistration Due to Speed Fluctuations of Drum Couplings>

The color misregistration may occur due to the shift of the first and second transfer positions 301 and 302 between the photosensitive drums 4 and the transfer belt 12, caused by the speed fluctuations of the drum couplings 71 and 72 that drive the photosensitive drums 4 while engaging with the photosensitive drums 4. In other words, to reduce the color misregistration caused by the drum couplings 71 and 72, the phase alignment needs to be performed using the first and second transfer positions 301 and 302 as references.

The phase alignment between the drum couplings 71 and 72 will be described with reference to FIG. 1. First, the angular relationship required for the phase alignment will be described based on the relationship among the first and second transfer positions 301 and 302 and the rotational centers of the respective gears 511, 512, and 52. Then, the phase alignment between the drum couplings 71 and 72 will be described.

<Relational Expression for Angles>

First, the angular relationship required for the phase alignment will be described with reference to FIG. 1, based on the relationship among the first and second transfer positions 301 and 302, a rotational center 52*c* of the driving force transmission gear 52 that meshes with the drum gears 511 and 512, and rotational centers 511*c* and 512*c* of the drum gears 511 and 512.

Assume that θ1 represents an angle formed in the rotational direction between a line connecting the rotational center 511*c* of the drum gear 511 and the rotational center 52*c* of the driving force transmission gear 52, and a line connecting the rotational center 511*c* of the drum gear 511 and the first transfer position 301. In FIG. 1, the angle θ1 is a first angle from the first meshing position K1 of the drum gear 511 with the driving force transmission gear 52 to the first transfer position 301 in the rotational direction of the drum gear 511.

Similarly, assume that θ2 represents an angle formed in the rotational direction between a line connecting the rotational center 512*c* of the drum gear 512 and the rotational center 52*c* of the driving force transmission gear 52, and a line connecting the rotational center 512*c* of the drum gear 512 and the second transfer position 302. In FIG. 1, the angle θ2 is a second angle from the second meshing position K2 of the drum gear 512 with the driving force transmission gear 52 to the second transfer position 302 in the rotational direction of the drum gear 512. The angles θ1 and θ2 are different from each other. More specifically, the first angle from the first meshing position K1 of the drum gear 511 to the first transfer position 301 in the rotational direction and the second angle from the second meshing position K2 of the drum gear 512 to the second transfer position 302 in the rotational direction are different from each other.

In addition, assume that θ3 represents an angle formed between a line connecting the rotational center 52*c* of the driving force transmission gear 52 and the rotational center 511*c* of the drum gear 511, and a line connecting the rotational center 52*c* of the driving force transmission gear 52 and the rotational center 512*c* of the drum gear 512.

Furthermore, assume that θ4 represents an angle formed between a line connecting the rotational center 511*c* of the drum gear 511 and the first transfer position 301, and a line connecting the first transfer position 301 and the second transfer position 302. Assume that θ5 represents an angle formed between a line connecting the rotational center 512*c* of the drum gear 512 and the second transfer position 302, and the line connecting the first transfer position 301 and the second transfer position 302.

Assuming that the first and second transfer positions 301 and 302 are the same position on each of the photosensitive drums 4, the following relational expression (1) is satisfied.

$$\theta 4+\theta 5=180 \tag{1}$$

The following relational expression (2) is satisfied based on a sum of interior angles of a hexagon formed by the first and second transfer positions 301 and 302, the rotational centers 511*c* and 512*c* of the two drum gears 511 and 512, and the rotational center 52*c* of the driving force transmission gear 52.

$$360-\theta 1+\theta 2+\theta 3+\theta 4+\theta 5=540 \tag{2}$$

Based on the above-described expressions (1) and (2), the following relational expression (3) is satisfied as the relationship among the above-described angles.

$$\theta 1-\theta 2=\theta 3 \tag{3}$$

<Phase Alignment Between Drum Couplings>

Next, the phase alignment between the drum couplings 71 and 72 will be described with reference to FIGS. 1 to 2D.

As described above, to reduce the color misregistration due to the speed fluctuations of the drum couplings 71 and 72 that drive the photosensitive drums 4 while engaging with the photosensitive drums 4, the phases of the drum couplings 71 and 72 need to be aligned using the first and second transfer positions 301 and 302 as the references. The configuration according to the present exemplary embodiment will be described next with reference to a comparative example.

As the comparative example, FIG. 2D illustrates, with a broken line, the speed fluctuation of the drum coupling 72 in a configuration where the drum gear and the drum coupling are integrated and are driven with only one phase. In the comparative example, the position of the drum coupling 72 relative to the drum gear 512 in the rotational direction of the drum gear 512 is the same as the position of the drum coupling 71 relative to the drum gear 511 in the rotational direction of the drum gear 511.

In the comparative example, the phase of the drum coupling 72 is also similar to the phase of the drum gear 512 as indicated by the broken line in FIG. 2D. In other words, the drum coupling 72 and the drum gear 512 are in a similar phase relationship to the relationship between the phase of the drum gear 511, which is adjacent to the drum gear 512 at the upstream position in the movement direction of the transfer belt 12, and the phase of the drum coupling 71, which engages with the drum gear 511. This causes a difference between the phase of the speed fluctuation of the drum coupling 71 of the drum gear 511 at the first transfer position 301 and the phase of the speed fluctuation of the drum coupling 72 of the drum gear 512 at the second transfer position 302, resulting in the color misregistration.

To address this, in the present exemplary embodiment, the phase alignment between the drum couplings 71 and 72 is performed so as to bring the speed fluctuations of the drum couplings 71 and 72 into phase at the first and second transfer positions 301 and 302. More specifically, the phase of the position of attaching one drum coupling to one of adjacent drum gears is shifted by a predetermined angular difference, using the position of attaching another drum coupling to the other drum gear as a reference.

First, to reduce the color misregistration due to the rotational fluctuations of the drum gears 511 and 512, the phase of the drum gear 512 is aligned with the phase delayed by the rotational angle θst relative to the drum gear 511 as described above, so that the phase of the drum gear 512 is aligned with the phase of the drum gear 511. More specifically, assuming that the drum gear 511 has the first tooth and the drum gear 512 has the second tooth corresponding to the first tooth of the drum gear 511, when the first tooth of the drum gear 511 is located at the first meshing position K1, the second tooth of the drum gear 512 is located at the position shifted from the second meshing position K2 by the rotational angle θst in the opposite direction of the rotational direction (second direction) of the drum gear 512. For example, when the first tooth of the drum gear 511 is located at the first meshing position K1 illustrated in FIG. 1 (the position indicated by the black circle), the second tooth of the drum gear 512 is located at the position shifted from the second meshing position K2 by the rotational angle θst in the opposite direction of the second direction (i.e., the position indicated by the broken line circle).

The first transfer position 301 is located at a position shifted by the angle θ1 from the first meshing position K1 of the drum gear 511. Similarly, the second transfer position 302 is located at a position shifted by the angle θ2 from the second meshing position K2 of the drum gear 512. FIGS. 2A to 2D illustrate the first meshing position K1 of the drum gear 511, the second meshing position K2 of the drum gear 512, the first transfer position 301, and the second transfer position 302 with vertical dot-dot dashed lines.

Next, the position of attaching the drum coupling 72 to the drum gear 512 is shifted by the predetermined angular difference θ1−θ2, using the position of attaching the drum coupling 71 to the drum gear 511 as the reference, in order to align the phases of the drum couplings 71 and 72 at the first and second transfer positions 301 and 302.

Assume that, with respect to a first portion of the drum coupling 71, a portion of the drum coupling 72 corresponding to the first portion is a second portion. Assume further that, in FIG. 1, when the first tooth of the drum gear 511 is located at the first meshing position K1, the first portion of the drum coupling 71 is located at the first transfer position 301 indicated by a black triangle.

In the comparative example, the position of attaching the drum coupling 71 to the drum gear 511, and the position of attaching the drum coupling 72 to the drum gear 512 are the same. In this configuration, when the second tooth of the drum gear 512 (corresponding to the first tooth of the drum gear 511) is located at the second meshing position K2, the second portion is located at a position shifted by the angle θ3 from the second transfer position 302 through which the second portion has passed. As a result, for example, when the speed of the drum coupling 71 is reduced at the first transfer position 301 as illustrated in FIG. 2C, the speed of the drum coupling 72 is increased at the second transfer position 302 as indicated by the broken line in FIG. 2D.

On the other hand, in the configuration according to the present exemplary embodiment, the position of attaching the drum coupling 72 to the drum gear 512 is shifted from the position of attaching the drum coupling 71 to the drum gear 511 by the angle θ3 in the opposite direction of the rotational direction of the drum gear 512. Accordingly, when the second tooth corresponding to the first tooth is located at the second meshing position K2, the second portion is located at the second transfer position 302. As a result, for example, when the speed of the drum coupling 71 is reduced at the first transfer position 301 as illustrated in FIG. 2C, the speed of the drum coupling 72 is also reduced at the second transfer position 302 as indicated by a solid line in FIG. 2D. Therefore, the color misregistration can be reduced.

Figure 5A:
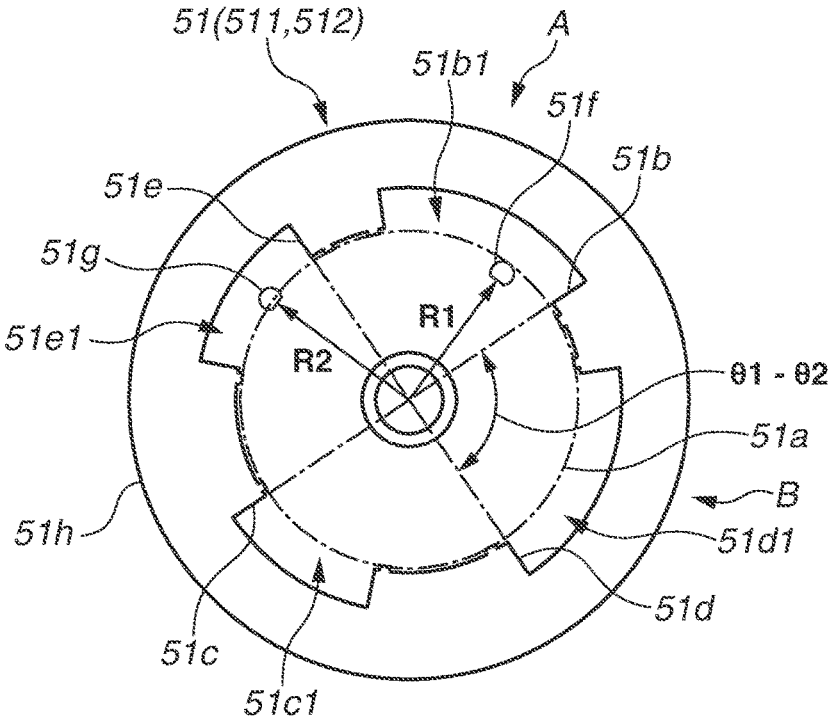
FIGS. 5A to 5C are diagrams illustrating phase alignment shapes of each drum gear and each drum coupling.

In the present exemplary embodiment, the drum gears 511 and 512 are the same drum gears molded with the same mold as described above, and each have two attachment positions (attachment portions) for attaching the drum couplings 71 and 72 at different phases. More specifically, as illustrated in FIG. 5A, the drum gears 511 and 512 each have a first position (a first attachment position) A, and a second position (a second attachment position) B shifted from the first position A by the above-described predetermined angular difference θ3 (=θ1−θ2), as coupling attachment positions.

At the first position A, the drum coupling 71 is attached to the drum gear 511 in such a manner that the reference phase for the speed fluctuation of the drum coupling 71 matches the first meshing position K1 (illustrated in FIG. 2C) of the drum gear 511 with the driving force transmission gear 52.

The second position B is different from the position corresponding to the first position A. At the second position B, the drum coupling 72 is attached to the drum gear 512. In this case, the reference phase for the speed fluctuation of the drum coupling 72 is shifted by the difference between the angles θ1 and θ2 in the opposite direction of the rotational direction of the drum gear 512, compared to when the drum coupling 72 is attached at the first position A of the drum gear 512. More specifically, the phase of the drum coupling 72 attached at the second position B of the drum gear 512 illustrated in FIG. 2B is shifted from the position indicated by the broken line illustrated in FIG. 2D to the position indicated by the solid line illustrated in FIG. 2D. The drum couplings 71 and 72 are connected to the drum gears 511 and 512, respectively by being selectively attached at the first position A or the second position B.

The drum gears 511 and 512 have the same shape. As illustrated in FIG. 5A, each of the drum gear 511 and the drum gear 512 has the two attachment positions (the first position A and the second position B). Each of the drum gear 511 and the drum gear 512 has the first position (the first attachment portion) A and the second position (the second attachment portion) B. In each of the drum gears 511 and 512, the second position B is located at the position shifted from the first position A by the difference between the angles θ1 and θ2 in the opposite direction of the rotational direction of each of the drum gears 511 and 512.

The drum coupling 71 is attached at the first position (the first attachment portion) A of the drum gear 511. The drum coupling 72 is attached at the second position (the second attachment portion) B of the drum gear 512.

With this configuration, as illustrated in FIGS. 2A and 2C, the drum coupling 71 engages with the drum gear 511 in such a manner that the reference phase for the speed fluctuation of the drum coupling 71 matches the first meshing position K1 of the drum gear 511. In this case, the tooth of the drum gear 511 located at the first meshing position K1 is referred to as a first reference tooth, and the tooth of the drum gear 512 corresponding to the first reference tooth (the tooth located at the same position as that of the first reference tooth in the rotational direction of the drum gear 512) is referred to as a second reference tooth. As illustrated in FIGS. 2B and 2D, when the second reference tooth of the drum gear 512 is located at the second meshing position K2, the reference phase for the speed fluctuation of the drum coupling 72 is shifted from the second meshing position K2 by the difference between the angles θ1 and θ2 in the opposite direction of the rotational direction, relative to the drum gear 512.

In other words, when the first position A matches the position of the first reference tooth in the drum gear 511, in the drum gear 512, the second position B is located at the position shifted from the second reference tooth by the difference between the angles θ1 and θ2 in the opposite direction of the rotational direction (second direction).

The drum couplings 71 and 72, which are molded from the same mold, have the same speed fluctuation during one rotation cycle from the above-described reference phase. In addition, the reference phase of the drum coupling 72 (the first transfer position 301 illustrated in FIG. 2D) corresponds to the reference phase of the drum coupling 71 (the first meshing position K1 illustrated in FIG. 2C) adjusted to the first meshing position K1 of the drum gear 511. Furthermore, as described above, the tooth of the drum gear 512 corresponding to the tooth of the drum gear 511 that meshes with the driving force transmission gear 52 at the first meshing position K1 is indicated by the broken line circle in FIG. 1.

In this manner, the drum gears 511 and 512 according to the present exemplary embodiment each have the plurality of phases for engaging the drum couplings 71 and 72. More specifically, the drum gears 511 and 512 each have the plurality of attachment positions for attaching the drum couplings 71 and 72 in such a manner that the drum couplings 71 and 72 are shifted from each other by the predetermined angular difference. With this configuration, the drum gears 511 and 512 allow the drum couplings 71 and 72 to be attached at different phases, thereby making it possible to align the phase of the drum coupling 71 at the first transfer position 301 and the phase of the drum coupling 72 at the second transfer position 302 with each other. As a result, the speed fluctuation of the drum coupling 71 at the first transfer position 301 and the speed fluctuation of the drum coupling 72 at the second transfer position 302 can be brought into phase without implementation of rotational phase control for aligning the rotational phases with each other. Thus, the color misregistration due to the speed fluctuations of the drum couplings 71 and 72 can be reduced. Furthermore, the misregistration among the respective colors due to the rotational fluctuations among the plurality of photosensitive drums 4 can be reduced.

<Attachment Positions of Drum Gear and Shape of Coupling>

Next, the shape for attaching the drum coupling 71 or 72 to the drum gear 51 will be described with reference to FIGS. 5A to 5C. Since the drum gears 511 and 512 have the same shape, the drum gears 511 and 512 will be collectively described as the drum gear 51 in the following description. In addition, since the drum couplings 71 and 72 have the same shape, the drum couplings 71 and 72 will be collectively described as the drum coupling 70 in the following description. However, the drum couplings 71 and 72 may not necessarily have the same shape at a portion not relating to the function for driving the photosensitive drum 4 as long as the drum couplings 71 and 72 have the same shape at a portion relating to the function for driving the photosensitive drum 4. Similarly, the drum gears 511 and 512 may not necessarily have the same shape at a portion not relating to the function for driving the photosensitive drum 4 as long as the drum gears 511 and 512 have the same shape at a portion relating to the function for driving the photosensitive drum 4.

Furthermore, even when there is a slight shape difference due to a dimensional tolerance at a portion relating to the function for driving the photosensitive drum 4, the drum couplings 71 and 72 can still be defined to have the same shape and the drum gears 511 and 512 can still be defined to have the same shape. For example, the drum couplings 71 and 72 and the drum gears 511 and 512 may include a portion that has a dimensional tolerance of −0.5 mm to +0.5 mm for the position or the dimension or has a dimensional tolerance of −3° to +3° for the angle.

It is desirable that the drum gears 511 and 512 are approximately exactly the same. For example, it is desirable that the drum gears 511 and 512 are molded from the same mold cavity. Furthermore, it is desirable that the drum couplings 71 and 72 are approximately exactly the same. For example, it is desirable that the drum couplings 71 and 72 are molded from the same mold cavity. In the present exemplary embodiment, the drum gears 511 and 512 and the drum couplings 71 and 72 are manufactured by resin molding.

A case where the drum gears 51 (511 and 512) mesh with the driving force transmission gear 52 at different angles and there are two driving force transmission points will be described. More specifically, a configuration of the driving unit 50 in which the two drum gears 51 (511 and 512) adjacent to each other mesh with the same single driving force transmission gear 52 will be described as an example. In other words, the configuration of the driving unit 50 including, as at least one driving force transmission gear, the single driving force transmission gear 52 that meshes with both the drum gears 511 and 512 will be described.

The drum coupling 70 includes engagement portions 70*g* (70*g*1 and 70*g*2) that engage with the photosensitive drum 4. The photosensitive drum 4 detachably engages with the engagement portions 70*g*. The speed of the photosensitive drum 4 may fluctuate due to variations in the positions of the engagement portions 70*g* in the rotational direction of the drum coupling 70. The drum gear 51 includes a positioning portion 51*a* that positions a positioning portion 70*a* of the drum coupling 70. At one of the attachment positions (the first position A), the drum gear 51 is provided with first and second driving force transmission surfaces 51*b* and 51*c* for driving the drum coupling 70. The second driving force transmission surface 51*c* is provided at a phase opposite to the phase of the first driving force transmission surface 51*b*. At the other attachment position (the second position B) having the phase difference of θ1−θ2, the drum gear 51 is provided with first and second driving force transmission surfaces 51*d* and 51*e* for driving the drum coupling 70. The second driving force transmission surface 51*e* is provided at a phase opposite to the phase of the first driving force transmission surface 51*d*.

Providing the drum gear 51 with the two attachment positions at different phases allows the drum couplings 70 (71 and 72) to be attached to the drum gears 51 while shifting the phases from each other by the difference in the angle from the meshing position to the primary transfer position. The two attachment positions (the first position A and the second position B) provided to each of the drum gears 51 are arranged in such a manner that the second position B is shifted from the first position A by the predetermined angular difference (θ1−θ2) in the opposite direction of the rotational direction of the drum gear 51. Thus, assuming that the rotational direction of the drum gear 51 is the counterclockwise direction in FIG. 5A, the first position A corresponds to the attachment position on the downstream side in the rotational direction, and the second position B corresponds to the attachment position on the upstream side in the rotational direction.

<Shape for Preventing Erroneous Attachment with Phase Difference of 180°>

The drum couplings 70 (71 and 72) as the coupling members each include a first protrusion portion 70*d*, which has a first width in the rotational direction, and a second protrusion portion 70*e*, which has a second width narrower than the first width in the rotational direction. The first protrusion portion 70*d* is provided in a manner protruding outward from the positioning portion (the outer peripheral surface) 70*a*. The second protrusion portion 70*e* is provided at a position opposite to the first protrusion portion 70*d* via the rotational center of the drum coupling 70, and is provided in a manner protruding outward from the positioning portion (the outer peripheral surface) 70*a*.

In the drum coupling 70, the first protrusion portion 70*d* includes a first driving force reception surface 70*b* that receives the driving force while being in contact with the first driving force transmission surface 51*b* or 51*d* of the drum gear 51. Also, in the drum coupling 70, the second protrusion portion 70*e* includes a second driving force reception surface 70*c* that receives the driving force while being in contact with the second driving force transmission surface 51*c* or 51*e* of the drum gear 51, at a position opposite to the first driving force reception surface 70*b* via the rotational center of the drum coupling 70.

Each of the drum gears 51 (511 and 512) has the first position A and the second position B that is shifted from the first position A by the predetermined angular difference in the rotational direction. One of the attachment positions of the drum gear 51 (the first position A) is provided with an attachment groove including a first groove portion 51*b*1 and a second groove portion 51*c*1. The other attachment position of the drum gear 51 (the second position B) is provided with an attachment groove including a first groove portion 51*d*1 and a second groove portion 51*e*1. The attachment groove including the first groove portion 51*b*1 and the second groove portion 51*c*1, and the attachment groove including the first groove portion 51*d*1 and the second groove portion 51*e*1 have the same shape.

The first groove portions 51*b*1 and 51*d*1 of the attachment positions each have a width allowing engagement of the first protrusion portion 70*d* in the rotational direction. The second groove portions 51*c*1 and 51*e*1 of the attachment positions are provided at the positions opposite to the first groove portions 51*b*1 and 51*d*1, respectively, via the rotational center of the drum gear 51, and each have a width narrower than the width of each of the first groove portions 51*b*1 and 51*d*1 and allowing engagement of the second protrusion portion 70*e* in the rotational direction.

In the drum gear 51, the first groove portions 51*b*1 and 51*d*1 include the first driving force transmission surfaces 51*b* and 51*d*, respectively, each of which transmits the driving force while being in contact with the first driving force reception surface 70*b*. Also, in the drum gear 51, the second groove portions 51*c*1 and 51*e*1 include the second driving force transmission surfaces 51*c* and 51*e*, each of which transmits the driving force while being in contact with the second driving force reception surface 70*c*, at the positions opposite to the first driving force transmission surfaces 51*b* and 51*d* via the rotational center of the drum gear 51, respectively.

As described above, each of the drum couplings 70 includes the first protrusion portion 70*d*, which has the first width in the rotational direction, and the second protrusion portion 70*e*, which has the second width narrower than the first width in the rotational direction. In addition, each of the drum gears 51 includes the first groove portions 51*b*1 and 51*d*1, each of which has the width allowing the engagement of the first protrusion portion 70*d* in the rotational direction, and the second groove portions 51*c*1 and 51*e*1, each of which has the width allowing the engagement of the second protrusion portion 70*e*, at the respective attachment positions (the first position A and the second position B). Each of the second groove portions 51*c*1 and 51*e*1 of the drum gear 51 is narrower in width in the rotational direction than each of the first groove portion 51*b*1 and 51*d*1 of the drum gear 51.

In other words, the drum gear 51 is configured in such a manner that only the second protrusion portion 70*e* of the drum coupling 70, which is narrower in width in the rotational direction than the first protrusion portion 70*d* of the drum coupling 70, can be attached to each of the second groove portions 51*c*1 and 51*e*1 of the drum gear 51.

Thus, if the drum coupling 70 is rotated by 180° before being attached to the drum gear 51, interference occurs between the first protrusion portion 70*d* of the drum coupling 70 and the second groove portion 51*c*1 or 51*e*1 of the drum gear 51, thereby resulting in attachment failure. Accordingly, the drum coupling 70 can be prevented from being attached at a wrong phase shifted by 180° with respect to each of the attachment positions of the drum gear 51.

<Prevention of Erroneous Attachment with Phase Difference of θ1−θ2>

Next, the shape for preventing erroneous attachment due to a difference in the phase angle of the drum coupling 70 will be described.

Each of the drum gears 51 includes a first phase hole 51*f* and a second phase hole 51*g* for phase determination. The first phase hole 51*f* is provided at a position distant from the rotational center of the drum gear 51 by a first radius R1. The second phase hole 51*g* is provided at a position distant from the rotational center of the drum gear 51 by a second radius R2 different from the first radius R1. The first phase hole 51*f* and the second phase hole 51*g* in each of the drum gears 51 are pin insertion holes.

Each of the drum couplings 70 includes a groove hole 70*f* and the positioning portion (the outer peripheral surface) 70*a*. The groove hole 70*f* is provided at a position distant from the rotational center of the drum coupling 71 by a third radius R3. The positioning portion (the outer peripheral surface) 70*a* is provided at a position distant from the rotational center of the drum coupling 71 by a fourth radius R4. The distance of the radius R3 at which the groove hole 70*f* is provided is shorter than each of the first radius R1 and the second radius R2. The distance of the radius R4 at which the positioning portion 70*a* is provided is longer than each of the first radius R1 and the second radius R2.

In this case, the relation of the radii R3<R1<R2<R4 is satisfied as the relation among the distances of the first phase hole 51*f* and the second phase hole 51*g* of the drum gear 51 and the distances of the groove hole 70*f* and the positioning portion 70*a* of the drum coupling 70 from the rotational centers.

Figure 5B:
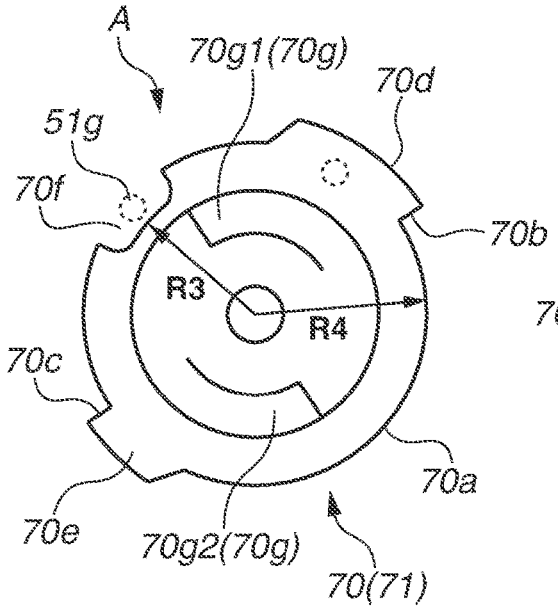

When the drum coupling 70 is attached to the first and second driving force transmission surface 51*b* and 51*c* at one of the attachment positions (the first position A) at the phase for driving the drum coupling 70, the drum coupling 70 is attached with a phase determination pin (not illustrated) inserted in the second phase hole 51*g* (refer to FIG. 5B). At this time, if the drum coupling 70 is to be attached to the first and second driving force transmission surfaces 51*d* and 51*e* at the other attachment position (the second position B) at the phase shifted by the angular difference of θ1−θ2, interference occurs between the phase determination pin inserted in the second phase hole 51*g* and the drum coupling 70, thereby resulting in attachment failure. Thus, the drum coupling 70 is prevented from being attached to the drum gear 51 at a wrong phase.

Figure 5C:
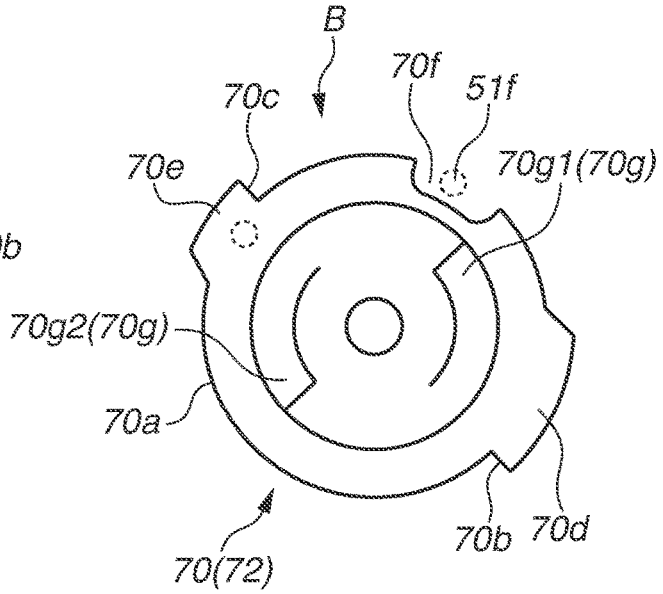

When the drum coupling 70 is attached to the first and second driving force transmission surfaces 51*d* and 51*e* at the other attachment position (the second position B) at the phase for driving the drum coupling 70, the drum coupling 70 is attached with a phase determination pin (not illustrated) inserted in the first phase hole 51*f* (refer to FIG. 5C). At this time, if the drum coupling 70 is to be attached to the first and second driving force transmission surfaces 51*b* and 51*c* at one of the attachment positions (the first position A) at the phase shifted by the angular difference of θ1−θ2, interference occurs between the phase determination pin inserted in the first phase hole 51*f* and the drum coupling 70, thereby resulting in attachment failure. Thus, the drum coupling 70 is prevented from being attached to the drum gear 51 at a wrong phase.

As illustrated in FIG. 5B, the drum coupling 71 does not overlap the second phase hole (second hole) 51*g* and overlaps the first phase hole (first hole) 51*f* in a state where the drum coupling 71 is attached at the first position A of the drum gear 511. As illustrated in FIG. 5C, the drum coupling 72 does not overlap the first phase hole 51*f* and overlaps the second phase hole 51*g* in a state where the drum coupling 72 is attached at the second position B of the drum gear 512.

As described above, according to the present exemplary embodiment, the misregistration among the respective colors due to the rotational fluctuations among the plurality of photosensitive drums can be reduced without the implementation of the rotational phase control for aligning the rotational phases of the drum gears with one another. Furthermore, when the drum couplings are attached to the drum gears at different attachment positions, the drum couplings can be attached at the respective attachment positions without mistake.

In the first exemplary embodiment, the single (same) driving force transmission gear 52 that meshes with the drum gears 51 that drive the photosensitive drums 4 adjacent to each other has been described as an example of at least one driving force transmission gear configured to rotate by receiving the driving force from the driving source. In a second exemplary embodiment, a configuration in which different driving force transmission gears mesh with the respective drum gears that drive the photosensitive drums adjacent to each other, as the above-described at least one driving force transmission gear will be described. The other configuration is similar to that according to the first exemplary embodiment, and thus a description thereof will be omitted.

Figure 6:
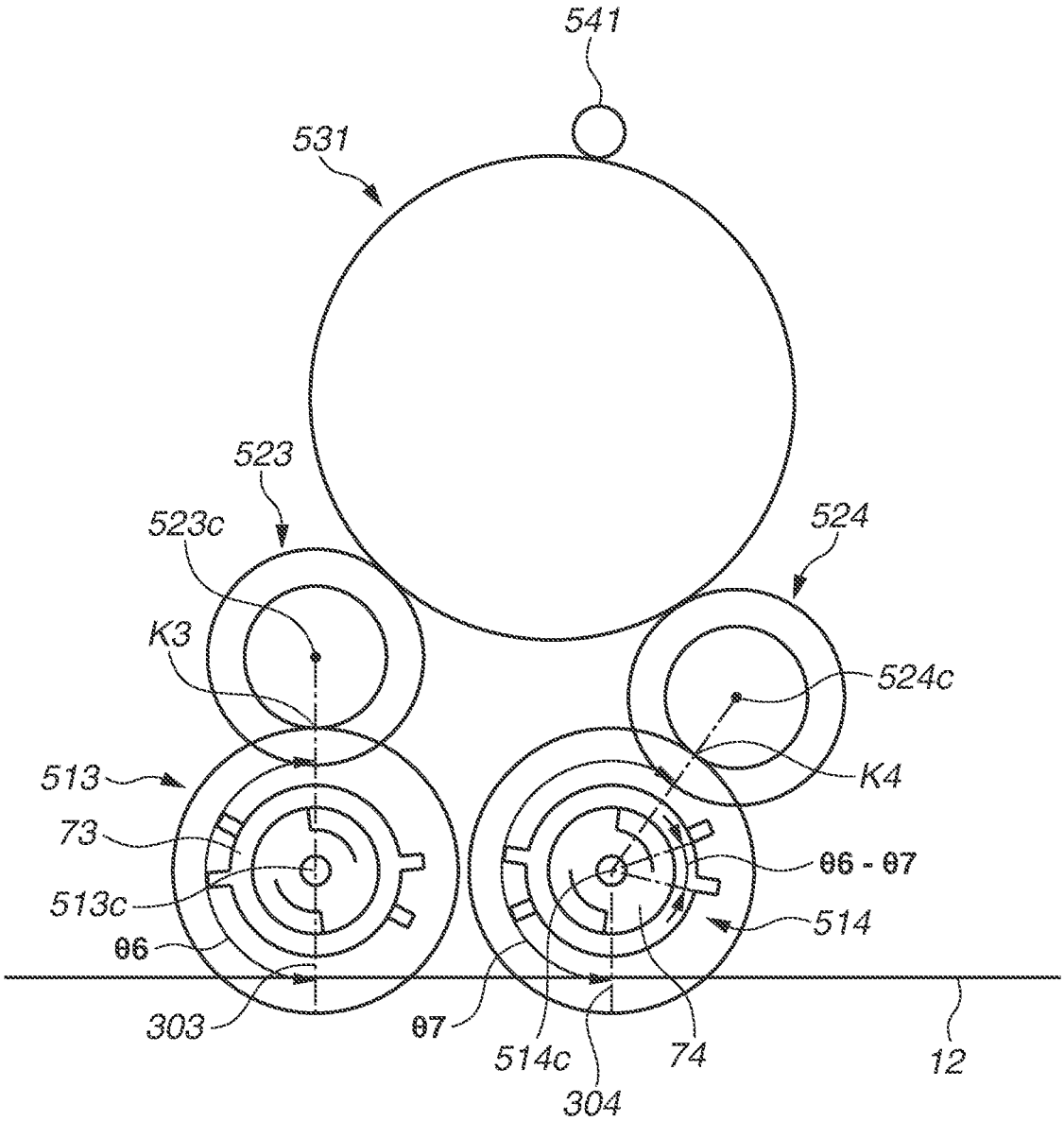
FIG. 6 is a diagram illustrating a configuration of a driving unit that drives each of a plurality of drum gears using a different driving force transmission gear.

The case where each of the drum gears meshes with a different driving force transmission gear will be described with reference to FIG. 6. FIG. 6 illustrates a schematic configuration of a part of a driving unit according to the present exemplary embodiment. In the driving unit according to the present exemplary embodiment, a first drum gear 513 meshes with a first driving force transmission gear 523, and is rotationally driven by receiving a driving force transmitted from the first driving force transmission gear 523. In addition, a second drum gear 514 adjacent to the first drum gear 513 meshes with a second driving force transmission gear 524 different from the first driving force transmission gear 523, and is rotationally driven by receiving a driving force transmitted from the second driving force transmission gear 524.

Furthermore, the first driving force transmission gear 523 and the second driving force transmission gear 524 mesh with a single (same) idler gear 531, and are rotationally driven by receiving a driving force transmitted from the idler gear 531. The idler gear 531 meshes with a pinion gear 541 attached to a motor (not illustrated) serving as the driving source, and is rotationally driven by receiving a driving force transmitted from the pinion gear 541.

Assume that θ6 represents an angle formed in the rotational direction between a line connecting a rotational center 513*c* of the first drum gear 513 and a rotational center 523*c* of the first driving force transmission gear 523, and a line connecting the rotational center 513*c* of the first drum gear 513 and a primary transfer position 303.

Similarly, assume that θ7 represents an angle formed in the rotational direction between a line connecting a rotational center 514*c* of the second drum gear 514 and a rotational center 524*c* of the second driving force transmission gear 524, and a line connecting the rotational center 514*c* of the second drum gear 514 and a primary transfer position 304.

The second drum gear 514 is arranged in such a manner that, when the first tooth of the first drum gear 513 is located at a meshing position K3, the second tooth of the second drum gear 514 corresponding to the first tooth is located at a phase shifted by the angle θst, in the opposite direction of the rotational direction, from a meshing position K4 with the second driving force transmission gear 524. In addition, assuming that a drum coupling 73 is attached to the first drum gear 513 at a first position, a drum coupling 74 is attached to the second drum gear 514 at a position shifted in phase from a position corresponding to the first position by an angular difference of θ6−θ7.

According to the present exemplary embodiment, even when each of the drum gears meshes with a different preceding-stage driving force transmission gear, the phases of the couplings can be aligned at the transfer positions and therefore the color misregistration can be reduced, similarly to the above-described first exemplary embodiment.

While in the present exemplary embodiment, the configuration not having <Shape for Preventing Erroneous Attachment with Phase Difference of 180°> or <Prevention of Erroneous Attachment with Phase Difference of θ1–θ2> according to the above-described first exemplary embodiment has been described, the configuration is not limited thereto. The configuration according to the present exemplary embodiment may have <Shape for Preventing Erroneous Attachment with Phase Difference of 180°> and/or <Prevention of Erroneous Attachment with Phase Difference of θ1–θ2>, similarly to the first exemplary embodiment.

A third exemplary embodiment will be described. While in the first and second exemplary embodiments, the configuration in which the drum gear and the drum coupling are separate members and the drum coupling is connected to the drum gear has been described, the configuration is not limited thereto. For example, the drum gear and the drum coupling may be integrally molded and configured as a gear molded with the phases shifted on the mold.

For example, the shape of the molded gear in which the drum coupling and the drum gear are integrally molded is molded with two parts in the axial direction, i.e., a recessed cavity and a protruding core. In the case of a helical gear, the tooth profile portion of the molded gear is molded in such a manner that a mold for molding the tooth profile portion is extruded while being rotated. At this time, phase alignment is performed using a return mechanism in such a manner that the shape of the tooth profile is located at the same position at each time of molding in order to make identical the phase relationship between the shapes of the attachment portion for attaching the coupling to the gear and of the phase determination hole, and the tooth portion of the gear.

In addition, a mold having the shape of the coupling and a mold having the shape of the gear can be attached while being rotated relative to each other, and are provided with a positioning hole for determining the phases of the molds in the rotational direction. Furthermore, the position of the pin for the phase determination hole that determines the phase of the molded gear can be changed between two positions. More specifically, when the gear is molded with a first phase, the pin is provided in the phase determination hole located at a distance corresponding to a first radius from the rotational center. On the other hand, when the gear is molded with a second phase shifted from the first phase by the predetermined phase difference (angular difference), the pin is provided in the phase determination hole located at a distance corresponding to a second radius, which is different from the first radius, from the rotational center. In this way, the phase determination hole can be provided to the gear.

With this method, the gears including the couplings having two attachment phases can be molded using the mold having one tooth profile. Furthermore, the difference between the two types of phases of the coupling in the molded gear can be distinguished based on the phase determination hole. Thus, even when the drum gear and the drum coupling are integrally molded, the molded gear can be attached so as to change the phase depending on the position at which the gear meshes with the preceding-stage driving force transmission gear, as described in the first exemplary embodiment.

While in the above-described exemplary embodiments, the printer has been described as an example of the image forming apparatus, the image forming apparatus is not limited thereto. For example, the exemplary embodiments of the present disclosure may be applied to other image forming apparatuses such as a copying machine, a facsimile apparatus, and a multifunction peripheral having a combination of these functions. Furthermore, while in the above-described exemplary embodiments, the image forming apparatus, which uses the intermediate transfer member, transfers the toner images for the respective colors onto the intermediate transfer member so as to superimpose the toner images sequentially, and transfers the toner images borne on the intermediate transfer member onto the recording medium all at once, has been described as an example, the image forming apparatus is not limited thereto. The exemplary embodiments of the present disclosure may also be applied to an image forming apparatus that uses a recording medium bearing member and transfers the toner images for the respective colors onto a recording medium borne on the recording medium bearing member so as to superimpose the images sequentially. Similar advantageous effects can be achieved by applying any of the exemplary embodiments of the present disclosure to these image forming apparatuses. The exemplary embodiments of the present disclosure may also be applied to a manufacturing method for manufacturing the image forming apparatus described in the exemplary embodiments.

According to the exemplary embodiments of the present disclosure, the phase of the first coupling member and the phase of the second coupling member can be aligned at the respective transfer positions. Therefore, the misregistration among the respective colors due to the rotational fluctuations among the plurality of photosensitive drums can be reduced without the implementation of the rotational phase control for aligning the rotational phases with one another.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-119169, filed Jul. 10, 2020 and Japanese Patent Application No. 2021-086109, filed May 21, 2021, each of which is hereby incorporated by reference herein in their entirety.

What is claimed is:

1. An image forming apparatus comprising:

a transfer member configured to move in a movement direction;

a first photosensitive drum disposed in contact with the transfer member at a first transfer position;

a second photosensitive drum disposed in contact with the transfer member at a second transfer position, wherein the second photosensitive drum is arranged adjacent to and side by side with the first photosensitive drum in the movement direction, and the second transfer position is located downstream of the first transfer position in the movement direction; and a driving unit configured to drive the first photosensitive drum and the second photosensitive drum, wherein the driving unit includes:

(i) a driving source, (ii) at least one driving force transmission gear configured to rotate by receiving a driving force from the driving source, (iii) a first drum gear that meshes with the at least one driving force transmission gear, wherein the first drum gear is configured to receive the driving force from the at least one driving force transmission gear to rotate in a first direction and drive the first photosensitive drum, (iv) a first coupling member provided at a first position of the first drum gear in the first direction, wherein the first coupling member is configured to rotate together with the first drum gear, and to rotate the first photosensitive drum while engaging with the first photosensitive drum, (v) a second drum gear that meshes with the at least one driving force transmission gear, wherein the second drum gear is configured to receive the driving force from the at least one driving force transmission gear to rotate in a second direction and drive the second photosensitive drum, and (vi) a second coupling member provided at a second position of the second drum gear in the second direction, wherein the second coupling member is configured to rotate together with the second drum gear, and to rotate the second photosensitive drum while engaging with the second photosensitive drum, wherein, assuming that a position where the first drum gear meshes with the at least one driving force transmission gear is a first meshing position and a position where the second drum gear meshes with the at least one driving force transmission gear is a second meshing position, a first angle from the first meshing position to the first transfer position in the first direction and a second angle from the second meshing position to the second transfer position in the second direction are different from each other, and wherein the second position of the second drum gear is shifted from a position corresponding to the first position of the first drum gear by a difference between the first angle and the second angle in a direction opposite of the second direction.

2. The image forming apparatus according to claim 1, wherein the first drum gear and the second drum gear have the same shape.

3. The image forming apparatus according to claim 1, wherein the first drum gear includes a first tooth that meshes with the at least one driving force transmission gear, wherein the second drum gear includes a second tooth that meshes with the at least one driving force transmission gear, where the second tooth corresponds to the first tooth, and wherein, assuming that an angle by which the second drum gear rotates before a toner image transferred to the transfer member at the first transfer position reaches the second transfer position is an angle θst, when the first tooth is located at the first meshing position, the second tooth is located at a position shifted from the second meshing position by the angle θst in the direction opposite of the second direction.

4. The image forming apparatus according to claim 1, wherein each of the first drum gear and the second drum gear includes a first attachment portion and a second attachment portion, wherein the second attachment portion of the first drum gear is located at a position shifted from the first attachment portion of the first drum gear by the difference between the first angle and the second angle in a direction opposite of the first direction, and the second attachment portion of the second drum gear is located at a position shifted from the first attachment portion of the second drum gear by the difference between the first angle and the second angle in the direction opposite of the second direction, and wherein the first coupling member is attached to the first attachment portion of the first drum gear, and the second coupling member is attached to the second attachment portion of the second drum gear.

5. The image forming apparatus according to claim 1, wherein the at least one driving force transmission gear includes a driving force transmission gear that meshes with both the first drum gear and the second drum gear.

6. The image forming apparatus according to claim 1, wherein the at least one driving force transmission gear includes a first driving force transmission gear that meshes with the first drum gear, and a second driving force transmission gear that meshes with the second drum gear.

7. The image forming apparatus according to claim 1, wherein each of the first coupling member and the second coupling member includes a first protrusion portion having a first width in a rotational direction of each of the first coupling member and the second coupling member, and a second protrusion portion having a second width narrower than the first width in the rotational direction, wherein each of the first drum gear and the second drum gear includes an attachment groove including a first groove portion having a width allowing engagement of the first protrusion portion and a second groove portion having a width narrower than the width of the first groove portion and allowing engagement of the second protrusion portion, and wherein each of the first drum gear and the second drum gear includes the attachment groove disposed at the first position of the first drum gear and the attachment groove disposed at the second position of the second drum gear.

8. The image forming apparatus according to claim 1, wherein each of the first drum gear and the second drum gear has a first hole and a second hole, wherein the first coupling member overlaps the first hole of the first drum gear and does not overlap the second hole of the first drum gear, and wherein the second coupling member overlaps the second hole of the second drum gear and does not overlap the first hole of the second drum gear.

* * * * *